US012146688B2

(12) United States Patent
Auyer et al.

(10) Patent No.: US 12,146,688 B2
(45) Date of Patent: Nov. 19, 2024

(54) REFRIGERANT VAPOR COMPRESSION SYSTEM WITH MULTIPLE FLASH TANKS

(71) Applicant: Carrier Corporation, Palm Beach, FL (US)

(72) Inventors: Douglas R. Auyer, Clay, NY (US); Jason D. Scarcella, Cicero, NY (US); KeonWoo Lee, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 657 days.

(21) Appl. No.: 17/248,154

(22) Filed: Jan. 12, 2021

(65) Prior Publication Data

US 2021/0239366 A1 Aug. 5, 2021

Related U.S. Application Data

(60) Provisional application No. 62/970,434, filed on Feb. 5, 2020.

(51) Int. Cl.

| | |
|---|---|
| ***F25B 1/10*** | (2006.01) |
| ***F25B 41/39*** | (2021.01) |
| ***F25B 49/02*** | (2006.01) |

(52) U.S. Cl.

CPC ..... *F25B 1/10* (2013.01); *F25B 49/02* (2013.01); *F25B 41/39* (2021.01); *F25B 2400/0409* (2013.01); *F25B 2600/2513* (2013.01)

(58) Field of Classification Search

CPC .. F25B 1/10; F25B 49/02; F25B 41/39; F25B 2400/0409; F25B 2600/2513; F25B 2345/004; F25B 2400/16; F25B 2400/161; F25B 43/00; F25B 43/006; F25B 2313/001

See application file for complete search history.

(56) References Cited

U.S. PATENT DOCUMENTS 5,056,329 A * 10/1991 Wilkinson ..... F25B 1/10 62/197
6,516,626 B2 2/2003 Escobar et al.
(Continued)

FOREIGN PATENT DOCUMENTS

AU 2015208087 A1 * 8/2016 ..... F25B 1/10
CN 111947302 A * 11/2020
(Continued)

OTHER PUBLICATIONS

English translation of Morimoto et al. (WO 2011099056 A1) (Year: 2011).*

(Continued)

*Primary Examiner* — Miguel A Diaz
(74) *Attorney, Agent, or Firm* — Souad Hakim

(57) ABSTRACT

A refrigerant vapor compression system comprising a plurality of components connected in a refrigerant flow circuit by a plurality of refrigerant lines, said components including: a compression device; a refrigerant heat rejection heat exchanger; a first expansion device; a refrigerant heat absorption heat exchanger; and a flash tank system having a first flash tank operably coupled to a second flash tank by a first connection, the flash tank system being disposed in the refrigerant flow circuit between the refrigerant heat rejection heat exchanger and the refrigerant heat absorption heat exchanger.

15 Claims, 5 Drawing Sheets

(56) References Cited

U.S. PATENT DOCUMENTS

| | | | | |
|---|---|---|---|---|
| 8,051,669 | B2 * | 11/2011 | Imai | F25B 19/04 62/DIG. 22 |
| 9,038,402 | B2 | 5/2015 | Sonninen | |
| 9,243,826 | B2 * | 1/2016 | Kawano | F25B 43/006 |
| 9,415,335 | B2 | 8/2016 | Zha et al. | |
| 9,683,762 | B2 * | 6/2017 | Kawano | F25B 30/02 |
| 9,689,588 | B2 * | 6/2017 | Matsuura | F25B 1/10 |
| 9,719,699 | B2 * | 8/2017 | Tamura | F25B 13/00 |
| 10,365,023 | B2 | 7/2019 | Zha et al. | |
| 11,473,814 | B2 * | 10/2022 | Zha | F25B 31/00 |
| 11,493,247 | B2 * | 11/2022 | Sun | F25B 49/02 |
| 2009/0095001 | A1 * | 4/2009 | Imai | F25B 19/04 62/196.3 |
| 2011/0174014 | A1 * | 7/2011 | Scarcella | F25B 9/008 62/512 |
| 2014/0047862 | A1 * | 2/2014 | Tamura | F25B 13/00 62/510 |
| 2014/0053595 | A1 * | 2/2014 | Kawano | F25B 43/006 62/498 |
| 2014/0053596 | A1 * | 2/2014 | Komori | F28B 1/00 62/498 |
| 2014/0053597 | A1 * | 2/2014 | Matsuura | F25B 1/00 62/510 |
| 2014/0326018 | A1 | 11/2014 | Ignatiev | |
| 2015/0260435 | A1 * | 9/2015 | Kawano | F25B 30/02 62/502 |
| 2016/0054033 | A1 * | 2/2016 | Matsuura | F25B 41/28 62/498 |
| 2019/0072299 | A1 | 3/2019 | Najafifard et al. | |
| 2019/0086130 | A1 * | 3/2019 | Hellmann | F25B 5/02 |
| 2020/0363102 | A1 * | 11/2020 | Zha | F25B 40/02 |
| 2020/0363109 | A1 * | 11/2020 | Sun | F25B 41/20 |

FOREIGN PATENT DOCUMENTS

| | | | | |
|---|---|---|---|---|
| CN | 113654262 | A * | 11/2021 | |
| CN | 114608214 | A * | 6/2022 | |
| EP | 3217108 | A1 | 9/2017 | |
| EP | 3550222 | A1 * | 10/2019 | F25B 1/10 |
| FR | 3111416 | A1 * | 12/2021 | |
| JP | 2012233616 | A * | 11/2012 | |
| JP | 2018059655 | A * | 4/2018 | |
| JP | 2021529923 | A * | 11/2021 | |
| KR | 20220020621 | A * | 2/2022 | |
| WO | WO-2011099056 | A1 * | 8/2011 | F25B 13/00 |
| WO | WO-2018154653 | A1 * | 8/2018 | F25B 43/00 |

OTHER PUBLICATIONS

Extended European Search Report received for EP Application No. 21155541.2, mailed on Jun. 28, 2021, 07 Pages.

Ma Liangdong et al: "Thermodynamic cycle performances analysis of high temperature refrigerants in a multi-stage heat pump system", Mechanic Automation and Control Engineering (MACE), 2010 International Conference On, IEEE, Piscataway, NJ, USA, Jun. 26, 2010 (Jun. 26, 2010), pp. 1515-1520.

* cited by examiner

REFRIGERANT VAPOR COMPRESSION SYSTEM WITH MULTIPLE FLASH TANKS

CROSS REFERENCE TO A RELATED APPLICATION

The application claims the benefit of U.S. Provisional Application No. 62/970,434 filed Feb. 5, 2020, the contents of which are hereby incorporated in their entirety.

BACKGROUND

This invention relates generally to refrigerant vapor compression systems and more particularly, to simultaneous efficiency improvement and reduced manufacturing cost of a refrigerant vapor compression system.

Refrigerant vapor compression systems are used for conditioning air to be supplied to a climate controlled comfort zone within a residence, office building, hospital, school, restaurant or other facility. Refrigerant vapor compression systems are also used in transport refrigeration systems for refrigerating air supplied to a temperature controlled cargo space of a truck, trailer, contain or the like for transportation perishable items.

The basic components of a refrigerant vapor compression system include a refrigerant compression device, a refrigerant heat rejection heat exchanger, and a refrigerant heat absorption heat exchanger, and an expansion device, commonly an expansion valve, disposed upstream, with respect to refrigerant flow, of the refrigerant heat absorption heat exchanger and downstream of the refrigerant heat rejection heat exchanger. These basic refrigerant system components are interconnected by refrigerant lines in a closed refrigerant circuit, arranged in a conventional manner in accord with a refrigerant vapor compression cycle. Such refrigerant vapor compression systems may be designed for and operated in a subcritical pressure range or in a transcritical pressure range depending upon the particular refrigerant with which the system is charged.

Refrigerant vapor compression systems operating in the subcritical range may be charged with fluorocarbon refrigerants such as, but not limited to, hydro chlorofluorocarbons (HCFCs) (e.g., R22), and hydrofluorocarbons (HFCs) (e.g., R134a, R410A and R407C). In today's market, greater interest is being shown in "natural" refrigerants, such as carbon dioxide, for use in air conditioning and transport refrigeration systems instead of HFC refrigerants. However, because carbon dioxide has a low critical temperature, most refrigerant vapor compression systems charged with carbon dioxide as the refrigerant are designed for operation in the transcritical pressure regime. In refrigerant vapor compression systems operating in a subcritical cycle, both the condenser and the evaporator heat exchangers can operate at refrigerant temperatures and pressures below the refrigerant's critical point. However, in refrigerant vapor compression systems operating in a transcritical cycle, the heat rejection heat exchanger, which may be a gas cooler rather than a condenser, can operate at a refrigerant temperature and pressure in excess of the refrigerant's critical point, while the evaporator can operate at a refrigerant temperature and pressure in the subcritical range.

Some vapor compression systems (subcritical or transcritical) may also include a flash tank system. In a subcritical compression system, the flash tank system is generally disposed in the refrigerant circuit downstream of the condenser and upstream of an expansion device. In a transcritical vapor compression system the flash tank system is generally disposed downstream of the gas cooler and upstream of an expansion device with respect to refrigerant flow. These systems typically include a single pressure vessel known as a flash tank. A flash tank is generally placed between the expansion valve and an evaporator in a refrigeration system to separate and bypass any flash gas (refrigerant vapor) formed in the valve and, to separate a refrigerant vapor/liquid mixture at an intermediate pressure.

Flash tank design and construction should meet certain minimum standards and are categorized by class (e.g., I, II, III, etc.) according to pressure and internal volume. Category II or higher flash tanks are typically used in subcritical or transcritical systems, and should be: (i) be capable of operating at a pressure range of >0.5 and ≤3000 bar; and have an internal volume of >1 liter; and (iii) have a pressure-times-volume range of >200 and ≤3000 bar liter. As a result, the use of a category II and higher flash tank in a refrigerant system requires certification and testing which can be time consuming and costly. A single flash tank in this application is generally bulky and adds weight to a vapor compression system, leaving few options for system configuration.

What is needed then, is a flash tank system that uses multiple flash tanks, and that are also safe to use, less costly to manufacture, have less weight and may allow for alternate and/or more compact configurations.

BRIEF DESCRIPTION OF THE INVENTION

According to one non-limiting embodiment, a refrigerant vapor compression system including a plurality of components connected in a refrigerant flow circuit by a plurality of refrigerant lines, said components including: a compression device; a refrigerant heat rejection heat exchanger; a first expansion device; a refrigerant heat absorption heat exchanger; a flash tank system having a first flash tank operably coupled to a second flash tank by a first connection, the flash tank system being disposed in the refrigerant flow circuit between the refrigerant heat rejection heat exchanger and the refrigerant heat absorption heat exchanger.

In addition to one or more of the features described above, or as an alternative, in further embodiments, a refrigerant vapor compression system wherein a connection includes a channel, conduit or pipe for providing refrigerant into and out of the flash tank system.

In addition to one or more of the features described above, or as an alternative, in further embodiments, a refrigerant vapor compression system wherein at least one of a first flash tank and a second flash is configured to have an operating pressure of less than one thousand bar, an internal volume of greater than one liter, and a pressure volume of less than two hundred bar-liter.

In addition to one or more of the features described above, or as an alternative, in further embodiments, a refrigerant vapor compression system wherein a first flash tank is configured to have an inlet port for receiving refrigerant from the refrigerant heat rejection heat exchanger into the flash tank system.

In addition to one or more of the features described above, or as an alternative, in further embodiments, a refrigerant vapor compression system wherein a second flash tank is configured to have an outlet port for providing refrigerant from the flash tank system to the compression device.

In addition to one or more of the features described above, or as an alternative, in further embodiments, a refrigerant vapor compression system wherein at least one of the first flash tank and the second flash tank is configured to have an outlet port for providing refrigerant from the flash tank system to the refrigerant heat absorption heat exchanger.

In addition to one or more of the features described above, or as an alternative, in further embodiments, a refrigerant vapor compression system wherein at least one of the first flash tank and the second flash tank have disposed therein an upper separation device and a lower separation device.

In addition to one or more of the features described above, or as an alternative, in further embodiments, a refrigerant vapor compression system wherein a separation device includes at least one of a baffle, partition plate and screen.

In addition to one or more of the features described above, or as an alternative, in further embodiments, a refrigerant vapor compression system wherein the first connection extends from the first flash tank between the upper separation device and the lower separation device, to the second flash tank between the upper separation device and the lower separation device.

In addition to one or more of the features described above, or as an alternative, in further embodiments, a refrigerant vapor compression system wherein the first connection is oriented above a second connection that operably couples the first flash tank to the second flash tank.

In addition to one or more of the features described above, or as an alternative, in further embodiments, a refrigerant vapor compression system wherein a third connection operably couples the first flash tank to the second flash tank, and is oriented below the first connection and the second connection.

In addition to one or more of the features described above, or as an alternative, in further embodiments, a refrigerant vapor compression system wherein the second connection extends from the first flash tank below the lower separation device, to the second flash tank below the lower separation device.

In addition to one or more of the features described above, or as an alternative, in further embodiments, a refrigerant vapor compression system wherein the third connection extends from a base of the first flash tank to a base of the second flash tank.

According to another non-limiting embodiment, a flash tank system, including: a first flash tank operably coupled to a second flash tank, by a first connection, wherein at least one of the first flash tank and the second flash is configured to have an operating pressure of less than one thousand bar, an internal volume of greater than one liter; and a pressure volume of less than two hundred bar-liter.

In addition to one or more of the features described above, or as an alternative, in further embodiments, the flash tank system wherein a connection includes a channel, conduit or pipe for providing refrigerant into and out of the flash tank system.

In addition to one or more of the features described above, or as an alternative, in further embodiments, the flash tank system wherein at least one of the first flash tank and the second flash tank have disposed therein an upper separation device and a lower separation device.

In addition to one or more of the features described above, or as an alternative, in further embodiments, the flash tank system wherein a separation device includes at least one of a baffle, partition plate and screen.

In addition to one or more of the features described above, or as an alternative, in further embodiments, the flash tank system wherein the first connection extends from the first flash tank between the upper separation device and the lower separation device, to the second flash tank between the upper separation device and the lower separation device.

In addition to one or more of the features described above, or as an alternative, in further embodiments, the flash tank system wherein the first connection is oriented above a second connection that operably couples the first flash tank to the second flash tank.

In addition to one or more of the features described above, or as an alternative, in further embodiments, the flash tank system wherein a third connection operably couples the first flash tank to the second flash tank, and is oriented below the first connection and the second connection.

In addition to one or more of the features described above, or as an alternative, in further embodiments, the flash tank system wherein the second connection extends from the first flash tank below the lower separation device, to the second flash tank below the lower separation device.

In addition to one or more of the features described above, or as an alternative, in further embodiments, the flash tank system wherein the third connection extends from a base of the first flash tank to a base of the second flash tank.

BRIEF DESCRIPTION OF THE DRAWINGS

The accompanying drawings form a part of the specification. Throughout the drawings, like reference numbers identify like elements.

DETAILED DESCRIPTION OF THE INVENTION

A detailed description of one or more embodiments of the disclosed apparatus and method are presented herein by way of example and not limitation with reference to the Figures.

Figure 1:
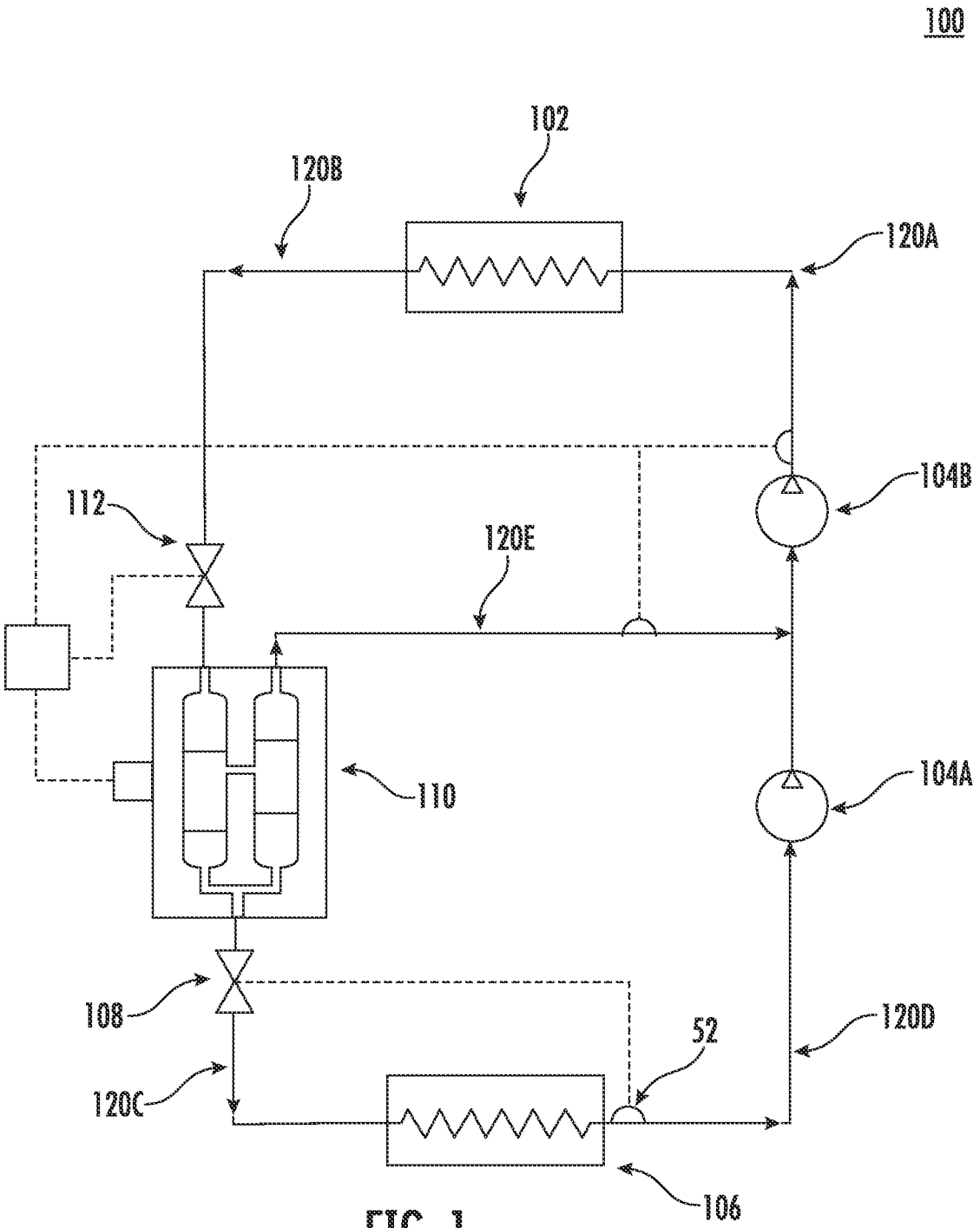
FIG. 1 is a system diagram illustrating components of a refrigeration circuit in accordance with embodiments of the disclosure.

Referring now to FIG. 1, the refrigerant vapor compression system 100 includes a compression device 104A, 104B. The compression device may be a pair of reciprocating compressors, connected in series, or a single reciprocating compressor, having a first bank and a second bank of cylinders, having a refrigerant line connecting the discharge outlet port of the first compressor 104A in refrigerant flow communication with the suction inlet port of the second compressor 104B or between the first and second banks of cylinders. Compression devices, 104A, 104B, function to compress and circulate refrigerant through a refrigerant circuit. The refrigerant vapor compression system 100 also includes a refrigerant heat rejecting heat exchanger 102, a refrigerant heat absorbing heat exchanger 106, also referred to herein as an evaporator, an evaporation expansion device 108 (also referred to as a first expansion device), illustrated as a valve, operatively associated with the evaporator 106, and various refrigerant lines 120A, 120B, 120C, 120D and 120E connecting the aforementioned components in a refrigerant circuit 120.

Additionally, the refrigerant vapor compression system 100 includes a flash tank system 110 disposed in the refrigerant circuit 120 between the refrigerant heat rejecting heat exchanger 102 and the refrigerant heat absorbing heat exchanger 106. A first expansion device, i.e., the evaporator expansion device 108, may be disposed in refrigerant line 120C downstream with respect to the liquid refrigerant flow of flash tank system 110 and upstream with respect to refrigerant flow of the heat absorbing heat exchanger 106. Additionally, a second expansion device 112, illustrated as an expansion valve, may be disposed in refrigerant line 120B downstream with respect to refrigerant flow of the heat rejecting heat exchanger 102 and upstream with respect to refrigerant flow of flash tank system 110. Therefore, the flash tank system 110 may be disposed in the refrigerant circuit 120 between the first expansion device 108 and the second expansion device 112.

In a refrigerant vapor compression system 100 operating in a subcritical cycle, the refrigerant heat rejecting heat exchanger 102 constitutes a refrigerant condensing heat exchanger through which hot, high pressure refrigerant passes in heat exchange relationship with a cooling medium, such as ambient air, in air conditioning systems or transport refrigeration systems. In a refrigerant vapor compression system 100 operating in a transcritical cycle, the refrigerant heat rejecting heat exchanger 102 is typically a gas cooler heat exchanger through which supercritical refrigerant passes in heat exchange relationship with a cooling medium, such as ambient air, in air conditioning systems or transport refrigeration systems.

Whether the system 100 is operating in a subcritical or a transcritical cycle, the refrigerant leaving the refrigerant heating rejecting heat exchanger 102 passes through refrigerant line 120B to flash tank system 110. In doing so, the refrigerant traverses the second expansion device 112 and expands to a lower pressure whereby the refrigerant enters flash tank system 110 as a mixture of liquid refrigerant and vapor refrigerant (vapor/liquid refrigerant mixture). In general, liquid refrigerant settles in the lower section of the flash tank system 110 and refrigerant vapor collects in the upper section of the flash tank system 110, as will be discussed in reference to FIGS. 2A-2D.

Liquid refrigerant passing from the flash tank system 110 through refrigerant line 120C traverses the first expansion device 108 disposed in the refrigerant line 120C upstream with respect to refrigerant flow of the evaporator 106. As this liquid refrigerant traverses the first expansion device 108, it expands to a lower pressure and temperature before the refrigerant enters the evaporator 106. The evaporator 106 constitutes a refrigerant evaporating heat exchanger through which expanded refrigerant passes in heat exchange relationship with a heating fluid, whereby the refrigerant is vaporized and typically superheated. The heating fluid passed in heat exchange relationship with the refrigerant in the evaporator 106 may be air to be supplied to a climate controlled environment such as a comfort zone associated with an air conditioning system or a perishable cargo storage zone associated with a transport refrigeration unit. The low pressure refrigerant vapor leaving the evaporator 106 returns through refrigerant line 120D to the suction port of the compression device 104A.

Expansion device 108, which may be a conventional thermostatic expansion valve or electronic expansion valve, receives a signal indicative of the refrigerant temperature or pressure sensed by the sensing device 52. Sensing device 52 may be a conventional temperature sensing element, such as a bulb or thermocouple for a TXV or a thermistor and/or pressure transducer for an EXV. Sensing device 52 meters the refrigerant flow through the refrigerant line 120C to maintain a desired level of superheat or pressure in the refrigerant vapor leaving the evaporator 106, also referred to as the suction temperature or the suction pressure.

In the refrigerant vapor compression system 100, the flask tank system 110 may serve not only as a charge control system, but also as an economizer. That is, the flash tank system 110 serves as both a means for phase separation, and also as a buffer reservoir in which refrigerant may collect and be stored during period of operation and periods when the system is inactive. In general, vapor refrigerant collecting in the upper section of flash tank system 110 as discussed below, passes from the flask tank system 110 through refrigerant line 120E and may flow into the refrigerant line connecting the discharge outlet port of the first compression device 104A in refrigerant flow communication with the suction inlet port of the second compressor 104B or between the first and second banks of cylinders.

Turning now to FIGS. 2A-2D, the flash tank system 110 includes at least two flash tanks 10A, 10B operably coupled by at least one connection 40A, 40B, 40C, each flash tank 10A, 10B, having at least one separation device 20A, 20B, 22A, 22B disposed therein for separating a two-phase vapor/liquid refrigerant mixture into saturated vapor refrigerant and saturated liquid refrigerant. A connection may include, but is not limited to a channel, conduit or pipe for providing or conveying refrigerant into and out of the flash tank system 110.

Figure 2A:
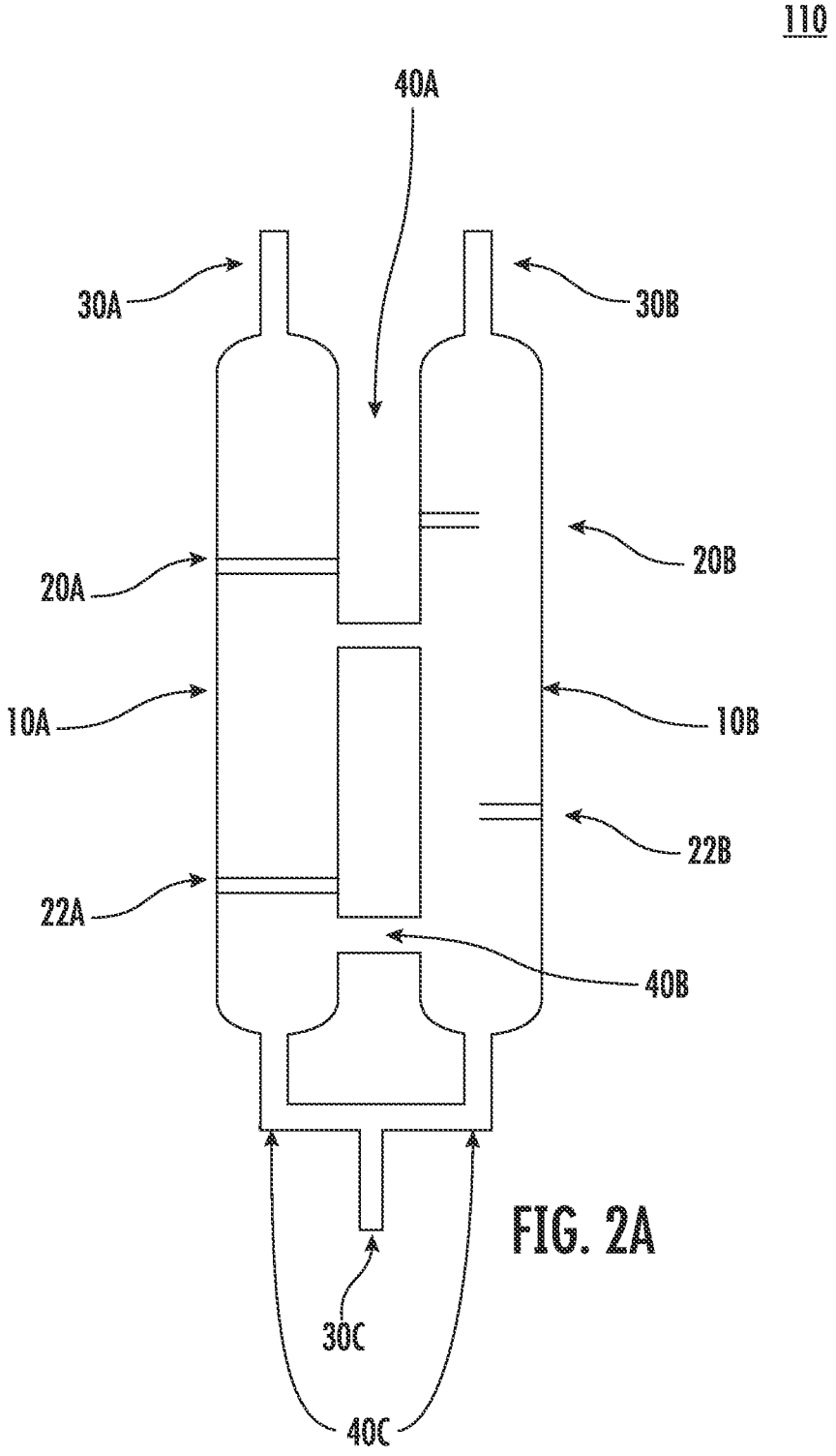
FIG. 2A is an enlarged view of a flash tank system in accordance with embodiments of the disclosure.

A flash tank 10A, 10B, and any connection 40A, 40B, 40C may be of any construction, design or shape, including a substantially cylindrical shape as shown in FIG. 2A. The shape, or internal or external configuration of a first flash tank 10A may be identical in all material respects to a second flash tank 10B. Alternatively, a first flash tank may differ from a second flash tank in shape or internal or external configuration. In some embodiments, a flash tank system 110 may include a flash tank 10A, 10B having an operating pressure of less than one thousand bar; and an internal volume of greater than one liter; and a pressure volume of less than two hundred 200 bar-liter.

In another non-limiting embodiment, the flash tank system 110 may be configured to permit a first flash tank 10A to be substantially parallel in a lengthwise orientation to a second flash tank 10B in the same orientation. For example, flash tank system 110 may be configured in a lengthwise, substantially parallel orientation, perpendicular to the horizontal plane of the refrigerant vapor compression system 100. The flash tank system 110 may be configured to permit one or more flash tanks 10A, 10B to be in general proximity to one another. In an alternate embodiment, a flash tank 10A, 10B may occupy a space within the refrigerant vapor compression system 100 that is not necessarily adjacent to another flash tank.

Referring to FIGS. 2A-2D, the separation process may differ depending on the number and placement of inlet and outlet ports 30A, 30B, 30C, the manner in which the flash tanks are operably coupled together by one or more connections 40A, 40B, 40C, and the location and placement of one more separation devices 20A, 20B, 22A, 22B. In general, high pressure and high temperature a vapor/liquid refrigerant mixture enters the flash tank system 110 through an inlet port 30A. The flash tank system 110 may be configured to permit saturated vapor to flow through an outlet port 30B where it may flow into the refrigerant line 120E, and to permit saturated liquid to flow through an outlet port 30C to expansion device 108.

A connection may operably couple a first flash tank 10A to at least a second flash tank 10B at any location, and in any orientation. It may be appreciated that a connection 40A, 40B may be configured to be perpendicular to one or more flash tanks, as generally illustrated in FIGS. 2A-2D, or may permit connection of one flash tank to another, by any orientation or connection angle. In addition to one or more of the features described above, or as an alternative, in further embodiments, a first flash tank 10A may be operably coupled to at least a second flash tank 10B, by at least one connection FIGS. 2A-2D, 40A, which aids the flow of refrigerant through the flash tank system 110 during the separation process. A flash tank system 110 may have one or more connections 40A, 40B, 40C based on a various factors such as a desired system configuration and performance. In addition, a connection may have any shape, dimension, orientation, and may be configured in any manner that aids in refrigerant flow and separation as later discussed.

In one non-limiting embodiment, referring to FIG. 2A, a first flash tank 10A may be operably coupled to at least a second flash tank 10B by means of at least two connections 40A, 40B, 40C. Alternatively, in another non-limiting embodiment, a first flash tank 10A may be operably coupled to a second flash tank 10B, by a single connection 40A as shown in FIG. 2C.

In addition to one or more of the features described above, or as an alternative, in further embodiments, connection may be configured to extend from a location above or below one or more separation devices. For example, in FIG. 2A, connection 40A may be below a separation device 20A, 20B. Separation devices 20A, 20B, may be referred to as upper separation device. In another example, in FIG. 2D, connection 40A may be above a separation device 20A, 20B. In another non-limiting embodiment, connection 40A may be above or below separation device 20A in a first flash tank, and above or below separation device 20B in a second flash tank. Connection 40C may be above or below one or more separation devices. For example, in FIGS. 2A, 2B and 2D, connection 40C may be below separation devices 22A, 22B. Separation devices 22A, 22B may be referred to as a lower separation device. In some embodiments, connection 40C may be above one or more separation devices 22A, 22B.

Connection 40A may be the first connection in the flash tank system 110 operably coupling a first flash tank 10A to a second flash tank 10B, and configured to be above other connections, for example, 40B, 40C. Connection 40A may allow vapor to rise and collect in the upper section of the flash tank system 110, and to flow from the flash tank system 110 to refrigerant line 120E. The upper section of flash tank system 110 may include the area above an upper separation device 20A, 20B.

Figure 2B:
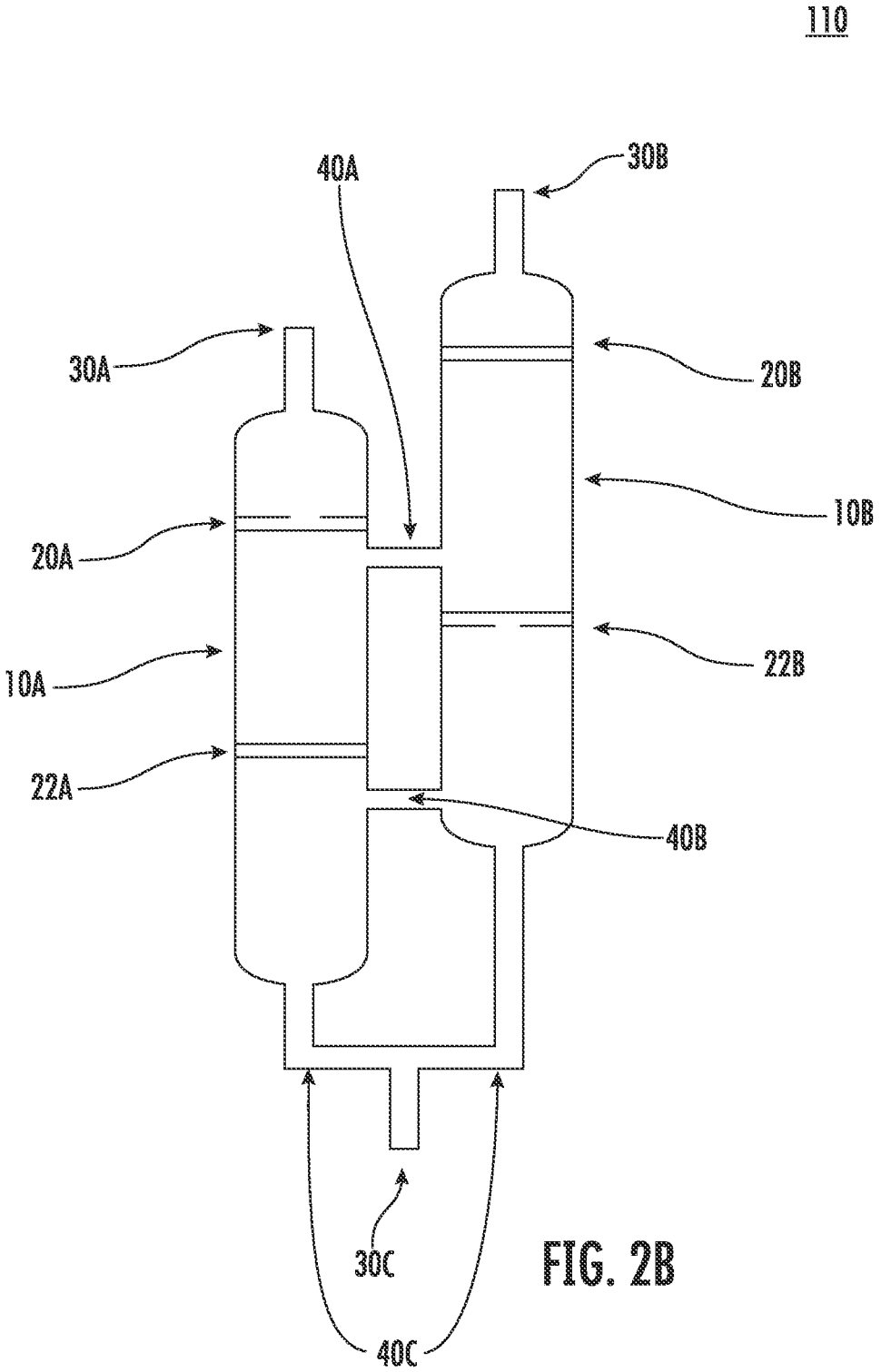
FIG. 2B is an enlarged view of a flash tank system in accordance with embodiments of the disclosure.
Figure 2C:
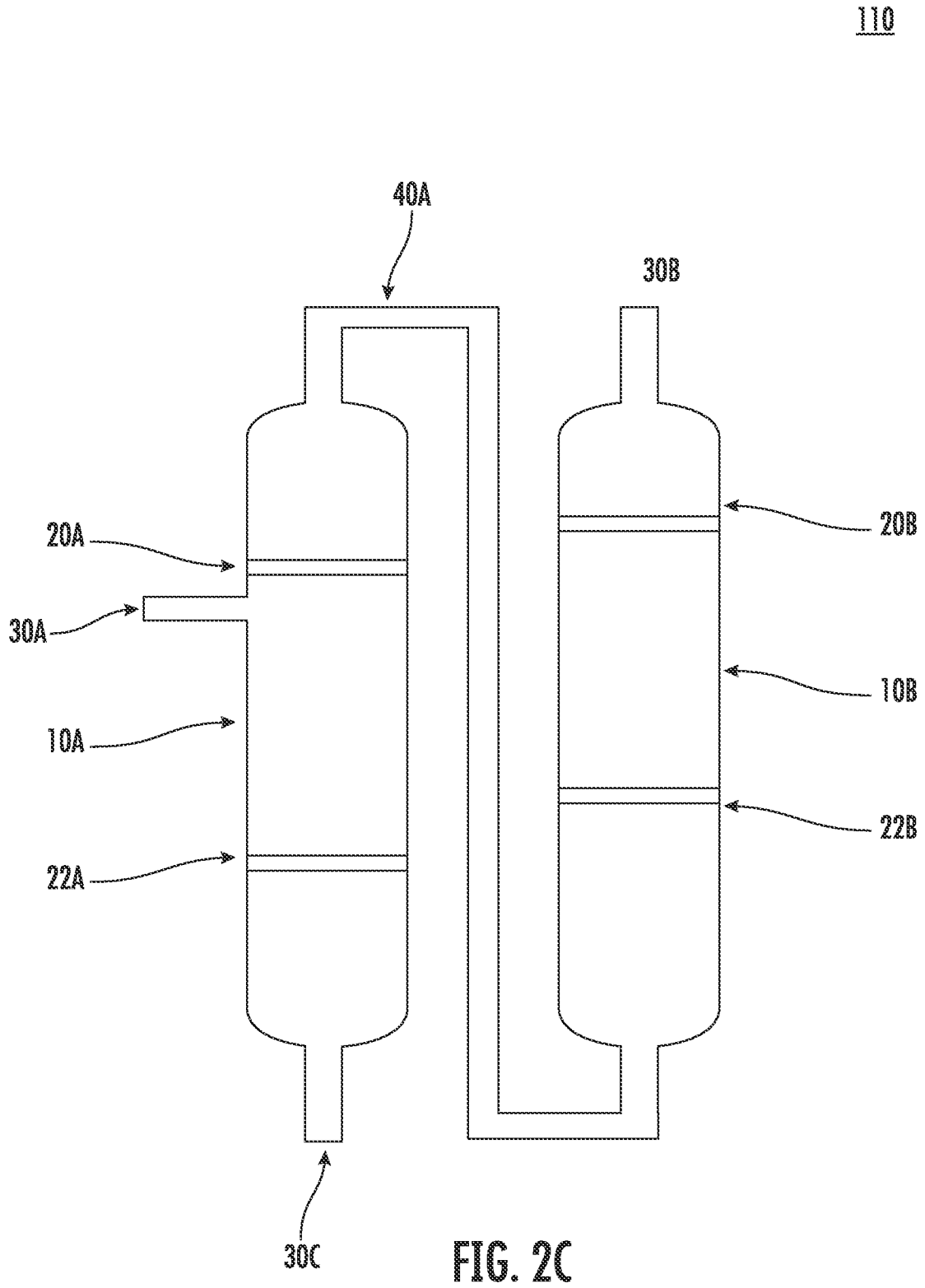
FIG. 2C is an enlarged view of a flash tank system in accordance with embodiments of the disclosure.

In one non limiting embodiment, connection 40A may extend from a middle section of the first flash tank 10A to a middle section of the second flash tank 10B, as generally illustrated in FIG. 2A, 2B. The middle section of a flash tank 10A, 10B may include the area between upper separation devices 20A, 20B and lower separation devices 22A, 22B.

In another alternative non-limiting embodiment, connection 40A may extend from the upper section of the first flash tank 10A to the lower section of the second flash tank 10B, as generally illustrated in FIG. 2C. The lower section of a flash tank 10A, 10B may be include the area below a lower separation device 22A, 22B.

Figure 2D:
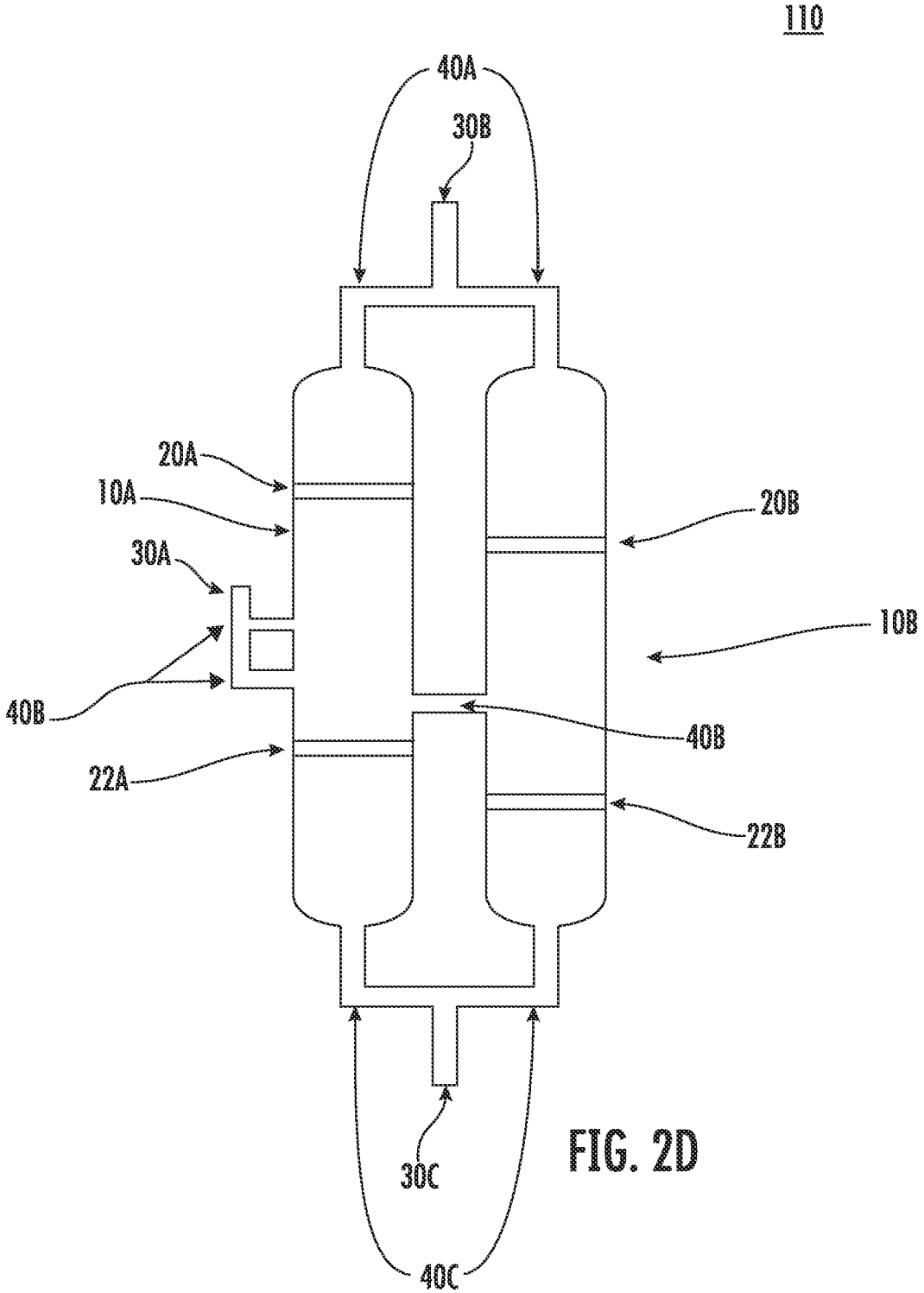
FIG. 2D is an enlarged view of a flash tank system in accordance with embodiments of the disclosure.

In yet another alternative non-limiting embodiment, connection 40A may extend from the upper section the first flash tank 10A to the upper section of the second flash tank 10B, as generally illustrated in FIG. 2D.

Connection 40B may be a second connection operably coupling a first flash tank 10A to a second flash tank 10B, and located between connection 40A and connection 40C. Connection 40C may be the third and lowest connection relative to connections 40A and 40B, in the flash tank system 110. In one non-limiting embodiment, connection 40B may extend from a lower section of the first flash tank 10A to a lower section of the second flash tank 10B, as generally illustrated in FIG. 2A, 2B.

In yet another non-limiting embodiment, connection 40B may extend from the middle portion of the first flash tank 10A to the middle portion of the second flash tank 10B, as generally illustrated in FIG. 2D.

Connection 40C may be a third connection operably coupling the first flash tank 10A to the second flash tank 10B. Connection 40C may extend from the base of the first flash tank 10A to the base of the second flash tank 10B. The base of a flash tank 10A, 10B may generally be lowest gravity point of a flash tank 10A, 10B. In one non-limiting embodiment, connection 40C may combine the flow of liquid refrigerant from a first flash tank 10A and a second flash tank 10B to an outlet port 30C and the heat absorption heat exchanger, as generally illustrated in FIG. 2A, 2B, 2D.

Referring to FIGS. 2A-2D, one or more separation devices 20A, 20B, 22A, 22B may aid in separating the vapor/liquid refrigerant mixture into a saturated refrigerant vapor and saturated refrigerant liquid. A separation device may have any shape or dimension, may be constructed of any material, and may be disposed within a flash tank 10A, 10B in any location or orientation, suitable for achieving vapor/liquid refrigerant separation.

In one non-limiting embodiment, a separation device 20A, 20B, 22A, 22B may include one or more baffles, partition plates and/or screens, or any combination thereof. In addition, the configuration of a separation device may vary. For example, a separation device may be a substantially flat plate 20A, or in addition to or in the alternative, may be a screen, that extends in whole 20A, 22A or in part 20B, 22B, across the horizontal plane of a flash tank 10A, 10B. In some embodiments, a separation device may be staggered 20B, 22B along an internal vertical surface of a flash tank 10A, 10B. For example, a separation device may be divided into two or more sections wherein each section may be located in two or more vertical planes and have a longitudinal distance between each section as shown in FIG. 2A, 20B, 22B. A separation device may have one or more holes of any number, shape, angle or dimension, or in any combination thereof, and at any distance from one another, and in any orientation, on a separation device, to aid in separation. For example, FIG. 2B illustrates separation device 20A having a hole on a top portion of the separation device, and separation 22B having a hole on a bottom portion of the separation device.

A separation device 20A, 20B, 22A, 22B may be disposed within a flash tank 10A, 10B, at any location therein. In one non-limiting embodiment, a flash tank 10A, 10B may have at least one upper separation device. For example, in FIG. 2A, flash tank 10A may have at least one upper separation device 20A, and flash tank 10B may also have an upper separation device 20B. In an alternate embodiment (not shown), a flash tank system 110 may include a first flash tank 10A having disposed therein at least one upper separation device, coupled to a second flash tank without an upper separation device. In another non-limiting embodiment, a flash tank 10A, 10B may have at least one lower separation device, for example separation devices 22A and 22B as shown in FIG. 2A. It may be appreciated that the number of, and location of, one or more separation devices disposed within a flash tank may vary depending on variety of factors, which may include separation efficiency and desired flow rate through the flash tank system 110.

In addition to one or more of the features described above, or as an alternative, in further embodiments, a separation device 20A, 20B, 22A, 22B may have any configuration or orientation within a flash tank 10A, 10B. In some embodiments, a separation device may have the same shape as a flash tank's cross-sectional area. For example, a separation device may be disposed substantially transversely across the plane of a flash tank 10A, 10B, or alternatively, may be disposed at any angle within a flash tank 10A, 10B that provides for separation of refrigerant into liquid refrigerant and vapor refrigerant for the next stage in the refrigeration cycle. It can be appreciated that the angle of any one separation device 20A, 20B, 22A, 22B may be the same as, or different from, any other separation device. In another non-limiting embodiment, a separation device may project from an internal vertical surface of flash tank 10A, 10B, into a space within a flash tank.

In addition to one or more of the features described above, or as an alternative, in further embodiments, at least two separation devices 20A, 20B, 22A, 22B may be disposed within each of flash tank 10A, 10B. A separation device may divide a flash tank 10A, 10B into two or more sections or parts (e.g., an upper section, a mid-section, and a lower section). Separation devices may be separated by a distance suitable for achieving separation of a two-phase vapor/liquid refrigerant mixture into a substantially liquid phase and substantially a vapor phase. For example, the spatial distribution of a separation device 20A, 20B, 22A, 22B within a flash tank 10A, 10B, may be the same or different from another flash tank. Stated differently, the volume between two adjacent flash tank sections divided by a separation device may the same or substantially similar, or they may be different. For example, turning to FIG. 2A, the volume of space between separation devices 20A and 22A, may be different from the volume of space between separation device 20B and 22B. In addition, the volume of space between a separation device and an inlet port or outlet port, may also be different. For example, in reference to FIG. 2A, the volume of space between 22A and outlet port 30C in flash tank 10A, may be different from the volume of space between 22B and outlet port 30C in flash tank 10B.

In general, a high pressure and high temperature vapor/liquid refrigerant mixture enters the flash tank system 110 through an inlet port 30A. The flash tank system 110 can be configured to permit vapor to flow through an outlet port 30B and into the refrigerant line 120E, and to permit saturated liquid to flow through an outlet port 30C to first expansion device 108.

An inlet 30A, may be provided for receiving a vapor/refrigerant mixture from a heat rejection heat exchanger 102. The location and configuration of inlet 30A may vary provided the flow of the vapor/liquid refrigerant into the flash tank system 110 generally unimpeded and permits separation to occur. In some non-limiting embodiments, as shown in FIGS. 2A and 2B, inlet port 30A may be located in the upper section of the flash tank system 110. In some embodiments, the vapor/liquid refrigerant mixture enters into a flash tank directly, as in FIG. 2A and FIG. 2B. In an alternate embodiment, the vapor/liquid refrigerant mixture enters the flash tank system 110 through inlet port 30A and may enter another connector FIG. 2D, 40B.

In some embodiments, an outlet port 30B may be provided to permit separated vapor refrigerant to flow into a refrigerant line 120E. The location and configuration of outlet port 30B may vary provided the flow of the separated vapor to a refrigerant line 120E is unimpeded. In some non-limiting embodiments, as shown in FIGS. 2A-2D, outlet port 30B may be located in the upper section of the flash tank system 110. In some embodiments, the vapor exits directly from a second flash tank 10B, as in FIG. 2A-2C. In an alternate embodiment, the separated vapor flows through outlet port 30B by way of a connector 40A that combines vapor from a first flash tank 10A and a second flash tank 10B.

In some embodiments, an outlet port 30C permits separated liquid refrigerant to flow through an expansion valve 108, and to a heat absorption heat exchanger 106). The location and configuration of outlet port 30C may vary provided the flow of the separated liquid refrigerate is unimpeded. In some non-limiting embodiments, the separated refrigerant flows through outlet port 30C from a first flash tank 10A, by way of a connection 40C, and combines with liquid refrigerant from a second flash tank 10B, by way of a connection 40C, before continuing to the heat absorption heat exchanger 106. In some non-limiting embodiments, as shown in FIG. 2C, separated liquid refrigerant may flow through outlet port 30C, directly from a first flash tank 10A as shown in FIG. 2C.

Turning to FIG. 2A, an exemplary embodiment of a flash tank system 110 is shown having at least two flash tanks, 10A, 10B. As previously discussed, flash tank system 110 may be configured to receive a vapor/liquid refrigerant mixture through inlet port 30A. Phase separation occurs in flash tank 10A aided by upper separation devices 20A, 20B, and in flash tank 10B aided by lower separation devices 20B, 22B. Some separation may occur naturally before the vapor/liquid mixture passes through one or more separation devices. Vapor that may be present upon entering inlet 30A, flows through connection 40A to outlet port 30B where the vapor may flow into refrigerant line 120E. The vapor/liquid refrigerant mixture entering inlet port 30A flows downward through flash tank 10A, where separation may be aided by separation devices 20A and 22A. As vapor separates from liquid as the mixture flows downward through flash tank 10A, the vapor rises and flows through connection 40A to outlet port 30B as previously discussed. The heavier liquid refrigerant flows downward to connector 40C and flows through outlet port 30C toward the heat absorption heat exchanger 106. Any remaining vapor remaining in flash tank 10A following separation through separation devices 20A and 20B, flows through connection 40B to flash tank 10B.

Some vapor/liquid refrigerant may also flow through connection 40B to flash tank 10B, where separation may be aided by separation devices 20B and 22B. As vapor separates from liquid in flash tank 10B, vapor rises and flows through outlet port 30B, while any remaining liquid refrigerant sinks and flows through connection 40C where it combines with the liquid refrigerant from flash tank 10A, to outlet port 30C, as discussed above.

Turning to FIG. 2B, an alternate embodiment of a flash tank system 110 is shown having at least two flash tanks, 10A, 10B. In an alternate configuration of a flash tank system 110 flash tank 10A may be vertically offset with respect to flash tank 10B, by the configuration and placement of connections 40A, 40B and 40C. In some embodiments, flash tanks 10B may be positioned higher than flash tank 10A so that a gravitational effect will permit more liquid refrigerant to be collected in 10A, and will permit more vapor to collect in the upper section of 10B. This may result in one portion of connection 40C having unequal dimensions. For example, as shown in FIG. 2B, the portion of connection 40C connecting the flash tank 10A to outlet port 30C may be shorter in length than the portion of connection 40C connecting flash tank 10B to outlet port 30C.

Turning to FIG. 2C, an alternate non-limiting embodiment of a flash tank system 110 is shown having at least two flash tanks, 10A, 10B. Flash tank system 110 may be configured to receive mixed-state refrigerant through inlet port 30A. Phase separation occurs in flash tank 10A aided by separation devices 20A, 20B. In this embodiment, separated liquid refrigerant collects in the bottom portion of flash tank 10A, exits through outlet port 30C, and flows to expansion valve 108. Separated vapor may collect in the upper section of flash tank 10A, and flows to flash tank 10B through connection 40A. Vapor may pass through separation devices 22B and 20B in flash tank 10B. In this alternate configuration, vapor may flow through flash tank 10B, and through outlet port 30B where the vapor may flow into a refrigerant line 120E connecting the discharge outlet port of the first compression device 104A in refrigerant flow communication with the suction inlet port of the second compressor 104B or between the first and second banks of cylinders.

Turning to FIG. 2D, an exemplary embodiment of a flash tank system 110 is shown having at least two flash tanks, 10A, 10B. In this alternate configuration, both flash tanks, 10A, 10B receive two phase refrigerant through inlet port 30A. A connection 40B permits two phase refrigerant to flow into each flash tank 10A, 10B. Separation may occur in each flash tank 10A, 10B. Separation devices 20A, 22A in flash tank 10A, and separation devices 20B and 22B may aid in two phase separation. Vapor collects in the upper section of each flash tank 10A, 10B and flows through outlet port 30B where the vapor may flow into the refrigerant line 120E Separated liquid refrigerant may collect in the bottom portion of flash tank 10A, 10B, and exit through connection 40C to outlet port 30C, and flows to first expansion valve 108.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

We claim:

1. A refrigerant vapor compression system comprising a plurality of components connected in a refrigerant flow circuit by a plurality of refrigerant lines, said components comprising:

a compression device;

a refrigerant heat rejection heat exchanger;

a first expansion device;

a refrigerant heat absorption heat exchanger;

a flash tank system having a first flash tank operably coupled to a second flash tank by a first connection, wherein the first flash tank and the second flash tank have disposed therein an upper separation device and a lower separation device and the first connection extends from the first flash tank between the upper separation device and the lower separation device to the second flash tank between the upper separation device and the lower separation device, the flash tank system being disposed in the refrigerant flow circuit between the refrigerant heat rejection heat exchanger and the refrigerant heat absorption heat exchanger, wherein the flash tank system is downstream of the refrigerant heat rejection heat exchanger and upstream of the refrigerant heat absorption heat exchanger with respect to liquid refrigerant flow.

2. The refrigerant vapor compression system of claim 1, wherein a connection includes a channel, conduit or pipe for providing refrigerant into and out of the flash tank system.

3. The refrigerant vapor compression system of claim 1, wherein at least one of the first flash tank and the second flash tank is configured to have an operating pressure of less than one thousand bar, an internal volume of greater than one liter, and a pressure volume of less than two hundred bar-liter.

4. The refrigerant vapor compression system of claim 1, wherein the first flash tank is configured to have an inlet port for receiving refrigerant from the refrigerant heat rejection heat exchanger into the flash tank system.

5. The refrigerant vapor compression system of claim 1, wherein the second flash tank is configured to have an outlet port for providing refrigerant from the flash tank system to the compression device.

6. The refrigerant vapor compression system of claim 1, wherein at least one of the first flash tank and the second flash tank is configured to have an outlet port for providing refrigerant from the flash tank system to the refrigerant heat absorption heat exchanger.

7. A flash tank system, comprising:

a first flash tank operably coupled to a second flash tank, by a first connection, wherein at least one of the first flash tank and the second flash is configured to have an operating pressure of less than one thousand bar, an internal volume of greater than one liter; and a pressure volume of less than two hundred bar-liter, wherein the first connection extends from the first flash tank between an upper separation device and a lower separation device, to the second flash tank between an upper separation device and a lower separation device.

8. The flash tank system of claim 7, wherein a connection includes a channel, conduit or pipe for providing refrigerant into and out of the flash tank system.

9. The flash tank system of claim 7, wherein the first connection is oriented above a second connection that operably couples the first flash tank to the second flash tank.

10. The flash tank system of claim 9, wherein a third connection operably couples the first flash tank to the second flash tank, and is oriented below the first connection and the second connection.

11. The flash tank system of claim 10, wherein the second connection extends from the first flash tank below the lower separation device, to the second flash tank below the lower separation device.

12. The flash tank system of claim 10, wherein the third connection extends from a base of the first flash tank to a base of the second flash tank.

13. A refrigerant vapor compression system comprising a plurality of components connected in a refrigerant flow circuit by a plurality of refrigerant lines, said components comprising:

a compression device;

a refrigerant heat rejection heat exchanger;

a first expansion device;

a refrigerant heat absorption heat exchanger;

a flash tank system having a first flash tank operably coupled to a second flash tank by a first connection, wherein at least one of the first flash tank and the second flash tank have disposed therein an upper separation device and a lower separation device and wherein the first connection is oriented above a second connection that operably couples the first flash tank to the second flash tank and a third connection operably couples the first flash tank to the second flash tank, and is oriented below the first connection and the second connection, the flash tank system being disposed in the refrigerant flow circuit between the refrigerant heat rejection heat exchanger and the refrigerant heat absorption heat exchanger, wherein the flash tank system is downstream of the refrigerant heat rejection heat exchanger and upstream of the refrigerant heat absorption heat exchanger with respect to liquid refrigerant flow.

14. The refrigerant vapor compression system of claim 13, wherein the second connection extends from the first flash tank below the lower separation device, to the second flash tank below the lower separation device.

15. The refrigerant vapor compression system of claim 13, wherein the third connection extends from a base of the first flash tank to a base of the second flash tank.

* * * * *